US012788061B2

(12) United States Patent
Wang et al.

(10) Patent No.: US 12,788,061 B2
(45) Date of Patent: Nov. 10, 2026

(54) AEROSOL CARTRIDGE

(71) Applicant: MICROPOROUS TECHNOLOGY (NINGBO) LTD, Ningbo (CN)

(72) Inventors: Lijuan Wang, Ningbo (CN); Liping Wang, Ningbo (CN); Ding Shen, Ningbo (CN); Xingfu Zhou, Ningbo (CN)

(73) Assignee: MICROPOROUS TECHNOLOGY (NINGBO) LTD., Ningbo (CN)

( * ) Notice: Subject to any disclaimer, the term of this patent is extended or adjusted under 35 U.S.C. 154(b) by 488 days.

(21) Appl. No.: 18/554,146

(22) PCT Filed: Nov. 18, 2021

(86) PCT No.: PCT/CN2021/131576
§ 371 (c)(1),
(2) Date: Oct. 5, 2023

(87) PCT Pub. No.: WO2022/222454
PCT Pub. Date: Oct. 27, 2022

(65) Prior Publication Data

US 2024/0196974 A1 Jun. 20, 2024

(30) Foreign Application Priority Data

Apr. 19, 2021 (CN) ..... 202110415965.7

(51) Int. Cl.

| | |
|---|---|
| ***A24F 40/42*** | (2020.01) |
| ***A24F 40/10*** | (2020.01) |
| ***A24F 40/44*** | (2020.01) |
| ***A24F 40/485*** | (2020.01) |

(52) U.S. Cl.
CPC ..... *A24F 40/42* (2020.01); *A24F 40/10* (2020.01); *A24F 40/44* (2020.01); *A24F 40/485* (2020.01)

(58) Field of Classification Search
None
See application file for complete search history.

(56) References Cited

U.S. PATENT DOCUMENTS

2020/0022417 A1* 1/2020 Atkins ..... A24F 40/485

FOREIGN PATENT DOCUMENTS

| | | | |
|---|---|---|---|
| CN | 110250576 | A | 9/2019 |
| CN | 110403246 | A | 11/2019 |
| CN | 111759010 | A | 10/2020 |
| CN | 211631799 | U | 10/2020 |
| CN | 212697666 | U | 3/2021 |

* cited by examiner

*Primary Examiner* — Cynthia Szewczyk
(74) *Attorney, Agent, or Firm* — Cherskov Flaynik & Gurda, LLC

(57) ABSTRACT

An aerosol cartridge is disclosed. The aerosol cartridge comprises a liquid storage element and an independent breath element that communicates the liquid storage element with atmosphere, the independent breath element includes an independent breath element core and at least one independent breath element through-hole axially penetrating through the independent breath element. The aerosol cartridge according to the present invention can precisely control the negative pressure in the liquid storage element, so that the liquid can be stably conducted from the liquid storage element, thereby stabilizing the atomization and reducing the risk of liquid leakage.

13 Claims, 12 Drawing Sheets

AEROSOL CARTRIDGE

TECHNICAL FIELD

The present application relates to an aerosol cartridge, and more particularly to an aerosol cartridge having an independent breath element which is used in the application field such as electronic cigarettes and drug solution atomization.

BACKGROUND

Techniques for atomizing liquid by heating are widely used in the fields of electronic cigarettes and the like. A common technique for electronic cigarettes is heating an atomizer wicking element which is directly communicated with the e-liquid to atomize the liquid, the atomizer wicking element for example is a glass fiber bundle or a cotton fiber bundle passing through an atomizing chamber housing. It is necessary that the atomizing chamber housing is properly matched with the atomizer wicking element, so that the liquid can be conducted from the atomizer wicking element while the external air can enter the liquid storage element from a gap between the atomizer wicking element and the atomizing chamber housing. Because the glass fiber bundle and the cotton fiber bundle are soft and short of a fixed shape, it is difficult to precisely control the gap between the atomizer wicking element and the atomizing chamber housing. When the gap is too large, there is too much liquid on the atomizer, which will cause the oil to be exploded during atomization, and in severe cases, the liquid will leak. When the gap is too small, air is difficult to enter the liquid storage element, which will cause the atomizer to be burned for lack of the liquid. These factors affect the stability of the atomization and consumption experience.

SUMMARY

In order to solve the problems existing in the prior art, the present invention provides an aerosol cartridge, which comprises a liquid storage element and an independent breath element that communicates the liquid storage element with atmosphere, the independent breath element includes an independent breath element core and at least one independent breath element through-hole axially penetrating through the independent breath element.

Further, the maximum inscribed circle diameter of the minimum cross-section of the independent breath element through-hole is 0.05 mm to 1.00 mm.

Further, the independent breath element core is made of plastic or metal.

Further, the independent breath element core is made by bonding fibers.

Further, the independent breath element core is made by bonding bicomponent fibers with a sheath-and-core structure.

Further, the sheath of the bicomponent fibers is polyethylene, polypropylene, polyethylene terephthalate, a copolyester of polyethylene terephthalate, polytrimethylene terephthalate, polybutylene terephthalate or polyamide 6.

Further, the independent breath element core has a density of 0.08-0.50 g/cm$^3$.

Further, the aerosol cartridge further comprises an atomizing chamber, an atomizing chamber housing, an atomizing chamber through-hole for communicating the atomizing chamber with the liquid storage element, and an atomizer, wherein the atomizer includes a heater and an atomizer wicking element.

Further, the atomizer blocks the atomizing chamber through-hole, and contacts the liquid in the liquid storage element through the atomizing chamber through-hole.

Further, the aerosol cartridge further comprises an atomizer relay wicking element made by bonding fibers, the atomizer relay wicking element blocks the atomizing chamber through-hole, and contacts the liquid in the liquid storage element through the atomizing chamber through-hole.

Further, the atomizer is a tubular porous material pre-embedded with a heater.

Further, the atomizing chamber housing is made of silicone rubber, high-temperature resistant plastic or stainless steel.

Further, the atomizer wicking element is a cotton fiber bundle, a glass fiber bundle, a porous ceramic, or a compressed cotton.

Further, the heater is a heating wire, a PCT thermistor, or a thick-film resistor.

Further, the independent breath element communicates the liquid storage element with the atomizing chamber.

Further, the independent breath element is provided on the side of the atomizing chamber housing, protrudes into the atomizing chamber from the side of the atomizing chamber housing, or protrudes into the liquid storage element from the side of the atomizing chamber housing.

Further, the independent breath element is provided on the top of the atomizing chamber housing, protrudes into the atomizing chamber from the top of the atomizing chamber housing, or protrudes into the liquid storage element from the top of the atomizing chamber housing.

Further, the aerosol cartridge further comprises an aerosol cartridge housing and a housing base provided at the bottom of the aerosol cartridge housing, and the independent breath element is provided on the housing base.

Further, the housing base comprises a first housing base provided at the bottommost of the aerosol cartridge housing, and a second housing base provided inside the aerosol cartridge housing and spaced apart from the first housing base, the independent breath element is provided on the second housing base.

Further, the atomizing chamber comprises an upper atomizing chamber and a lower atomizing chamber.

Further, the aerosol cartridge further comprises an aerosol channel, and the independent breath element and the aerosol channel are integrally formed.

Further, the aerosol cartridge further comprises an atomizer, the atomizer includes a heater and an atomizer wicking element heated by the heater, and the lower end surface of the independent breath element extends to near the atomizer wicking element.

The aerosol cartridge of the present invention is suitable for atomization of various liquids, such as e-cigarette liquid, drug solution, and the like. The independent breath element provided independently from the atomizer can more flexibly select the mounting position of the independent breath element, and selecting a more suitable independent breath element core can better control the pressure in the liquid storage element and the liquid conduction from the liquid storage element. The aerosol cartridge of the present invention can precisely control the negative pressure in the liquid storage element, so that the liquid can be stably conducted from the liquid storage element, and the liquid content on the atomizer wicking element is stable, thereby stabilizing the atomization and reducing the risk of liquid leakage. The providing of the independent breath element can enable the atomizer wicking element to directly communicate with the liquid storage element, or communicate with the liquid storage element by the relay wicking element, the former is beneficial to rapidly convey the liquid to the atomizer wicking element, and the latter is beneficial to control the conveying speed of the liquid. In order to make the above-mentioned content of the present invention more obvious and easier to understand, preferred embodiments are hereinafter described in detail with reference to the accompanying drawings.

BRIEF DESCRIPTION OF THE DRAWINGS

One or more embodiments are illustrated by way of example with reference to the pictures in the corresponding drawings, which do not constitute a limitation on the embodiments, elements having the same reference numerals in the accompanying drawings are represented as similar elements, unless specifically stated, the figures in the drawings do not constitute a proportion limitation.

DETAILED DESCRIPTION

Figure 1A:
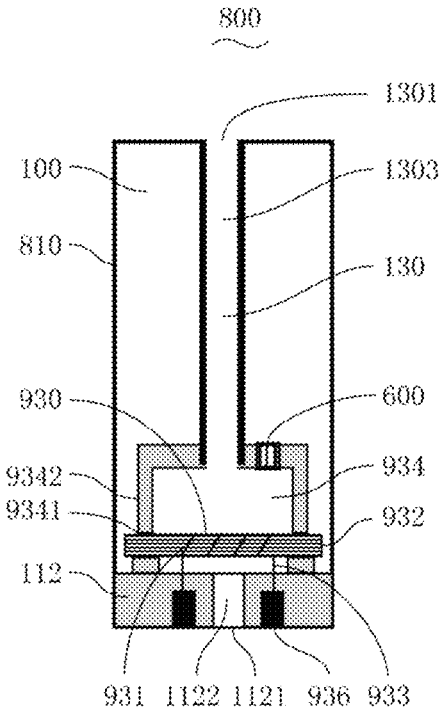
FIG. 1*a* shows a first schematic structural view of an aerosol cartridge according to the first embodiment of the present invention.

The embodiments of the present invention are described below by way of specific embodiments, and those skilled in the art can readily understand other advantages and functions of the present invention from the disclosure of the present invention.

Exemplary embodiments of the present invention will now be described with reference to the accompanying drawings; however, the invention may be embodied in many different forms and is not limited to the embodiments described herein, which are provided for the purpose of providing a detailed and complete disclosure of the present invention, and fully conveying the scope of the invention to those skilled in the art. The terminology shown in the exemplary embodiments in the drawings is not intended to be limiting of the present invention. In the drawings, the same elements/components generally use the same or similar reference numerals.

As used herein, the terms including scientific and technical terms have the meanings commonly understood to one skilled in the art, unless otherwise indicated. In addition, it is to be understood that a term defined in commonly used dictionaries should be understood to have a consistent meaning in the context of its associated domain and should not be interpreted as an idealized or overly formal meaning.

The First Embodiment

Figure 1B:
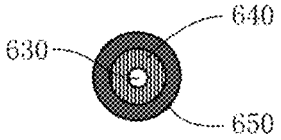
FIG. 1*b* shows a first schematic cross-sectional view of an independent breath element in the aerosol cartridge according to the first embodiment.
Figure 1C:
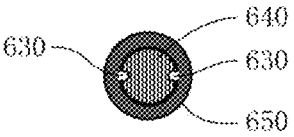
FIG. 1*c* shows a second schematic cross-sectional view of the independent breath element in the aerosol cartridge according to the first embodiment.
Figure 1D:
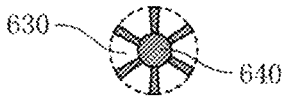
FIG. 1*d* shows a third schematic cross-sectional view of the independent breath element in the aerosol cartridge according to the first embodiment.
Figure 1E:
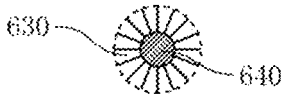
FIG. 1*e* shows a fourth schematic cross-sectional view of the independent breath element in the aerosol cartridge according to a first embodiment.
Figure 1F:
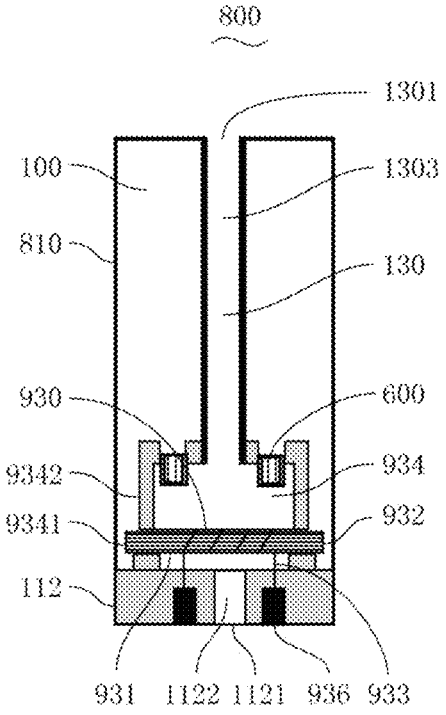
FIG. 1*f* shows a second schematic structural view of the aerosol cartridge according to the first embodiment of the present invention.
Figure 1G:
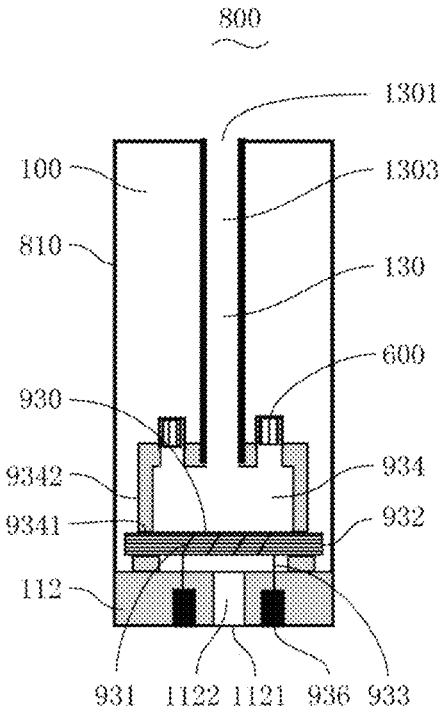
FIG. 1*g* shows a third schematic structural view of the aerosol cartridge according to the first embodiment of the present invention.
Figure 1H:
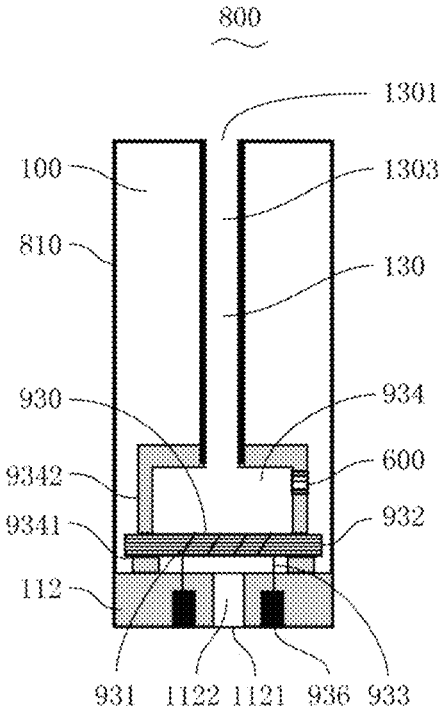
FIG. 1*h* shows a fourth schematic structural view of the aerosol cartridge according to the first embodiment of the present invention.

FIG. 1*a* shows a first schematic structural view of an aerosol cartridge according to the first embodiment of the present invention; FIG. 1*b* shows a first schematic cross-sectional view of an independent breath element in the aerosol cartridge according to the first embodiment; FIG. 1*c* shows a second schematic cross-sectional view of the independent breath element in the aerosol cartridge according to the first embodiment; FIG. 1*d* shows a third schematic cross-sectional view of the independent breath element in the aerosol cartridge according to the first embodiment; FIG. 1*e* shows a fourth schematic cross-sectional view of the independent breath element in the aerosol cartridge according to a first embodiment; FIG. 1*f* shows a second schematic structural view of the aerosol cartridge according to the first embodiment of the present invention; FIG. 1*g* shows a third schematic structural view of the aerosol cartridge according to the first embodiment of the present invention; FIG. 1*h* shows a fourth schematic structural view of the aerosol cartridge according to the first embodiment of the present invention.

As shown in FIGS. 1*a* to 1*h*, the aerosol cartridge 800 according to the first embodiment of the present invention comprises a liquid storage element 100 and an independent breath element 600 that communicates the liquid storage element 100 with atmosphere, the independent breath element 600 includes an independent breath element core 640 and at least one independent breath element through-hole 630 axially penetrating through the independent breath element 600, the through-hole 630 is an breath channel.

In the present invention, the independent breath element 600 is independent of wicking channels in an atomizer wicking element 932 and a relay wicking element 939 as described later and the like, that is, the wicking channels in the atomizer wicking element 932 and the later-described relay wicking element 939 and the like do not participate in forming the peripheral wall of the independent breath element through-hole 630. Unlike that the wicking channel participates in forming the breath channel in the wicking element of the prior art, the atomizer wicking element 932 and the later-described relay wicking element 939 in the present invention do not participate in forming the breath channel of the independent breath element 600.

The aerosol cartridge 800 further comprises an atomizing chamber 934, an atomizing chamber housing 9342, an atomizing chamber through-hole 9341 for communicating the atomizing chamber 934 with the liquid storage element 100, and an atomizer 930. The atomizer 930 blocks the atomizing chamber through-hole 9341, and contacts the liquid in the liquid storage element 100 through the atomizing chamber through-hole 9341. The atomizing chamber through-hole 9341 for communicating the atomizing chamber 934 with the liquid storage element 100 is formed by penetrating through the atomizing chamber housing 9342.

Specifically, in the present embodiment, the aerosol cartridge 800 comprises an aerosol cartridge housing 810, a housing base 112 provided at the bottom of the aerosol cartridge housing 810, an atomizing chamber housing 9342 provided inside the aerosol cartridge housing 810, an atomizing chamber 934 surrounded by the atomizing chamber housing 9342 and the housing base 112, an aerosol channel 1303 extending from the top of the atomizing chamber housing 9342 to the top of the aerosol cartridge housing 810, a liquid storage element 100 provided among the aerosol cartridge housing 810, the aerosol channel 1303, the atomizing chamber housing 9342 and the housing base 112, and an atomizer 930 provided in the atomizing chamber 934.

The atomizer 930 comprises a heater 931 and an atomizer wicking element 932 heated by the heater 931.

The atomizing chamber housing 9342 is provided with the atomizing chamber through-hole 9341 that communicates the atomizing chamber 934 with the liquid storage element 100 and penetrates through the atomizing chamber housing 9342, and the two ends of the atomizer wicking element 932 pass through the atomizing chamber through-hole 9341 to contact the liquid in the liquid storage element 100. Preferably, the atomizer wicking element 932 is tightly fitted with the atomizing chamber through-hole 9341, the atomizer 930 blocks the atomizing chamber through-hole 9341 and contacts the liquid in the liquid storage element 100 through the atomizing chamber through-hole 9341.

Liquid Storage Element

In the aerosol cartridge 800 of the present invention, the liquid storage element 100 is a component for storing the atomized liquid. The liquid storage element 100 can store different kinds of liquid therein according to the purpose of application, such as e-cigarette liquid, drug solution, etc. The liquid storage element 100 can have various cross-sectional shape, such as circular, elliptical, rectangular, etc., and can also be a combination of various geometric shapes.

The liquid storage element 100 may have a liquid storage element through-hole 130 axially penetrating through the liquid storage element 100. The liquid storage element through-hole 130 can be served as the aerosol channel 1303 of the aerosol cartridge 800. One end of the aerosol channel 1303 communicates with the atomizing chamber 934, the other end is an aerosol outlet 1301. The aerosol channel 1303 can be integrally formed with the liquid storage element 100, the liquid storage element through-hole 130 is served as the aerosol channel 1303, or it can be separately made of plastic, metal, glass, etc. and then assembled into the aerosol cartridge 800. A condensate absorbing element (not shown) can be installed in the aerosol channel 1303 to absorb condensate, thereby improving consumption experience.

Atomizing Portion

The atomizing portion of the present invention comprises an atomizing chamber housing 9342, an atomizing chamber 934 and an atomizer 930. The atomizing chamber 934 is a housing where the liquid is vaporized or atomized, and is surrounded by the atomizing chamber housing 9342 and the housing base 112. In the present embodiment, the atomizing chamber 934 is provided at the lower portion of the liquid storage element 100. The atomizer 930 is provided in the atomizing chamber 934, the housing base 112 is provided with a base through-hole 1122 penetrating through the base, and one end of the base through-hole 1122 in communication with the outside is served as an air inlet 1121, the external air enters the atomizing chamber 934 through the air inlet 1121. The liquid is atomized by the atomizer 930 in the atomizing chamber 934 and escapes from the aerosol cartridge 800 through the aerosol channel 1303.

The atomizer 930 of the present invention generally refers to a component that can vaporize or atomize the liquid according to use requirements, such as a glass fiber bundle wrapped around a heating wire, a cotton fiber bundle wrapped around a heating wire, a porous ceramic pre-embedded with a heating wire, a ceramic printed with a thick-film resistance, an ultrasonic atomizing head, etc. The atomize 930 comprises an atomizer wicking element 932 and a heater 931 for heating the atomizer wicking element 932. The atomizer wicking element 932 is capillary material, such as a glass fiber bundle, a cotton fiber bundle, a PET polyester fiber bundle, or a porous ceramic, etc. The heater 931 may be a heating wire, a PCT thermistor, or a thick-film resistor, etc. The atomizer 930 further comprises a wire 933 connected to a wire pin 936 or a power supply (not shown).

The atomizer wicking element 932 contacts the liquid in the liquid storage element 100 through the atomizing chamber through-hole 9341 of the atomizing chamber housing 9342. In order to avoid liquid leakage or air leakage, the atomizer wicking element 932 should be tightly fitted with the atomizing chamber through-hole 9341 of the atomizing chamber housing 9342, for example, the glass fiber bundle or the cotton fiber bundle should be tightly fitted with the atomizing chamber through-hole 9341 of the atomizing chamber housing 9342.

The atomizing chamber through-hole 9341 is preferably provided on the side wall of the atomizing chamber housing 9342. It also can be that a part of the atomizing chamber through-hole 9341 is formed on the atomizing chamber housing 9342, another part of the atomizing chamber through-hole 9341 is formed on the housing base 112, when the atomizing chamber housing 9342 and the housing base 112 are combined, the atomizing chamber through-hole 9341 is formed.

Independent Breath Element

In the present embodiment, the independent breath element 600 communicates the liquid storage element 100 with atmosphere. Specifically, the independent breath element 600 communicates the liquid storage element 100 with the atomizing chamber 934, and the external atmosphere enters the liquid storage element 100 through the air inlet 1121, the base through-hole 1122, the atomizing chamber 934 and the independent breath element 600, so that the liquid storage element 100 is communicated with the atmosphere through the independent breath element 600. The external atmosphere can also enter the liquid storage element 100 through the aerosol channel 1303, the atomizing chamber 934 and the independent breath element 600, so that the liquid storage element 100 is communicated with the atmosphere through the independent breath element 600.

In the present embodiment, the independent breath element 600 comprises an independent breath element through-hole 640 and at least one independent breath element through-hole 630 axially penetrating through the independent breath element 600. The independent breath element 600 further comprises an independent breath element cover 650 covering the outer peripheral wall of the independent breath element core 640 to install the independent breath element core 640. As shown in FIG. 1*b*, the independent breath element through-hole 630 may be provided in the independent breath element core 640, or as shown in FIG. 1*c*, the independent breath element through-hole 630 may be provided between the independent breath element core 640 and the independent breath element cover 650. Also as shown in FIGS. 1*d* and 1*e*, multiple fan-shaped cutouts are formed on the peripheral wall of the independent breath element core 640 to form the independent breath element through-holes 630, and preferably the fan-shaped independent breath element through-holes 630 are evenly distributed on the outer periphery of the independent breath element core 640.

The independent breath element core 640 can be made of plastic or metal, and the surface of the core can be soaked by the atomized liquid. All plastics can be made into the core, including thermoplastics and thermosetting plastics. Thermoplastics are more convenient to manufacture the core and can be manufactured by techniques such as injection molding and extrusion molding.

The independent breath element core 640 can also be a capillary material with a fixed shape, preferably the independent breath element core 640 is made by bonding fibers, because the liquid has a high permeation speed in the bonder fibers, which is beneficial to improve the sensitivity of the independent breath element 600. Especially, the independent breath element core 640 is preferably made by bonding bicomponent fibers with the sheath-core structure, these fibers can be bonded without adhesives and molded by heating, thereby reducing the risk of harmful substances. Preferably, the sheath of the bicomponent fibers is polyethylene, polypropylene, polyethylene terephthalate (PET), a copolyester of polyethylene terephthalate (Co-PET), polytrimethylene terephthalate (PTT), polybutylene terephthalate (PBT) or polyamide 6. The independent breath element core 640 has a density of 0.08-0.50 g/cm$^3$, preferably 0.15-0.30 g/cm$^3$. For example, the independent breath element core 640 can have a density of 0.08 g/cm$^3$, 0.10 g/cm$^3$, 0.15 g/cm$^3$, 0.20 g/cm$^3$, 0.25 g/cm$^3$, 0.30 g/cm$^3$, 0.35 g/cm$^3$, 0.40 g/cm$^3$, 0.45 g/cm$^3$, 0.50 g/cm$^3$. The cross-section of the independent breath element core 640 can have various geometric shapes, such as circle, ellipse, polygon and so on.

In the present invention, the independent breath element through-hole 630 is a capillary channel, and its size is expressed by the maximum inscribed circle diameter of the minimum cross-section of the independent breath element through-hole 630. The maximum inscribed circle diameter of the minimum cross-section of the independent breath element through-hole 630 is 0.05 mm to 1 mm, such as 0.05 mm, 0.08 mm, 0.10 mm, 0.20 mm, 0.30 mm, 0.40 mm, 0.50 mm, 0.60 mm, 0.80 mm, 1.00 mm. When the viscosity of the atomized liquid is smaller or the required atomization amount is less, the independent breath element through-hole 630 may be set smaller; when the viscosity of the atomized liquid is higher or the required atomization amount is larger, the independent breath element through-hole 630 may be set bigger. The cross-section of the independent breath element through-hole 630 can be provided with various geometric shapes, such as circle, sector, ring, polygon and so on.

When the independent breath element 600 contacts the liquid, the liquid is soaked and liquid-sealed the independent breath element through-hole 630 under the action of capillary force. The strength of the liquid seal is determined by the viscosity and surface tension of the liquid, the materials of the independent breath element core 640 and the independent breath element cover 650, and the size of the independent breath element through-hole 630, etc.

As shown in FIG. 1*a*, the independent breath element 600 can be provided on the top of the atomizing chamber housing 9342. This arrangement allows the independent breath element 600 to capture some of the heat from the aerosol, and be cooled by the liquid in the liquid storage element 100 at the same time, so that the independent breath element 600 can work stably.

As shown in FIG. 1*f*, the independent breath element 600 can also be provided on the top of the atomizing chamber housing 9342 and protruded into the atomizing chamber 934. This arrangement allows the independent breath element 600 to capture the heat from the aerosol to the utmost degree, reducing the viscosity of the liquid in the independent breath element 600, and improving the breath capacity, which is especially suitable for use in cold environments.

As shown in FIG. 1*g*, the independent breath element 600 can also be provided on the top of the atomizing chamber housing 9342 and protruded into the liquid storage element 100. This arrangement allows the independent breath element 600 to be cooled by the liquid in the liquid storage element 100 to the utmost degree, maintaining the viscosity of the liquid in the independent breath element 600, and maintaining the strength of the liquid seal, which is especially suitable for use in hot environments.

As shown in FIG. 1*h*, the independent breath element 600 can also be provided on the side of the atomizing chamber housing 9342, or protruded into the atomizing chamber 934 from the side of the atomizing chamber housing 9342, or protruded into the liquid storage element 100 from the side of the atomizing chamber housing 9342.

After the aerosol cartridge 800 is assembled, the independent breath element through-hole 630 is liquid-sealed after the independent breath element 600 absorbs sufficient liquid, the atomizer wicking element 932 absorbs the liquid in the liquid storage element 100, and the negative pressure in the liquid storage element 100 is increased until it reaches an equilibrium state, the liquid content of the atomizer wicking element 932 reaches a certain level. When in use, the liquid in the atomizer wicking element 932 is heated and atomized, then an aerosol generated in the atomizing chamber 934 escapes through the aerosol channel 1303. The atomizer wicking element 932 absorbs the liquid from the liquid storage element 100 and replenishes around the heater 931. As the liquid is conducted, the negative pressure in the liquid storage element 100 increases, and the liquid in the independent breath element 600 gradually returns to the liquid storage element 100 until the liquid seal of the independent breath element through-hole 630 is opened, the air in the atomizing chamber 934 enters the liquid storage element 100 through the independent breath element through-hole 630, so that the negative pressure in the liquid storage element 100 is dropped, and the independent breath element through-hole 630 is liquid-sealed again. This process is repeated so that the atomization process can continue until the liquid in the liquid storage element 100 is used up.

The Second Embodiment

Figure 2A:
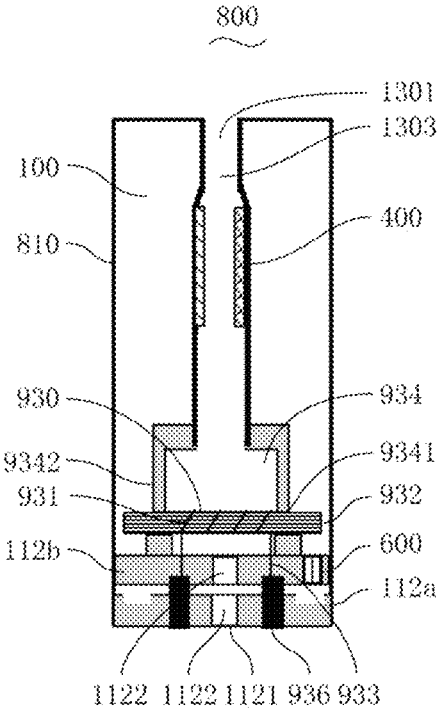
FIG. 2*a* shows a schematic structural view of an aerosol cartridge according to the second embodiment of the present invention.
Figure 2B:
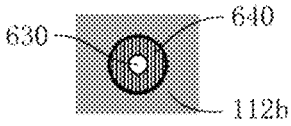
FIG. 2*b* shows a schematic cross-sectional view of an independent breath element in the aerosol cartridge according to the second embodiment.
Figure 2C:
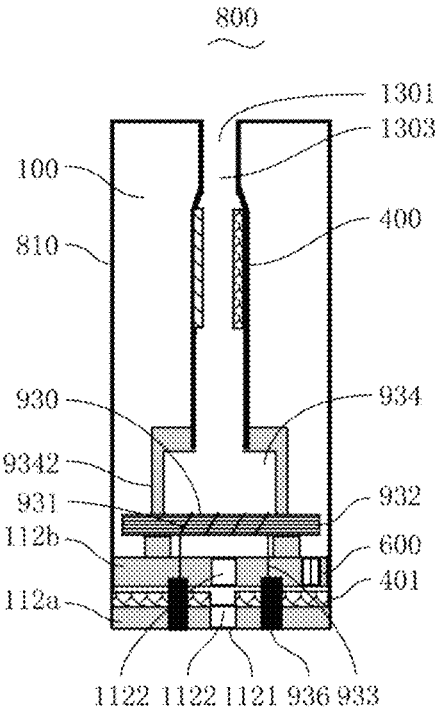
FIG. 2*c* shows another schematic structural view of the aerosol cartridge according to the second embodiment of the present invention.

FIG. 2*a* shows a schematic structural view of an aerosol cartridge according to the second embodiment of the present invention; FIG. 2*b* shows a schematic cross-sectional view of an independent breath element in the aerosol cartridge according to the second embodiment; FIG. 2*c* shows another schematic structural view of the aerosol cartridge according to the second embodiment of the present invention. The structure of the present embodiment is similar to that of the first embodiment, and the same parts as the first embodiment will not be repeated in the description of this embodiment.

As shown in FIG. 2*a*, the aerosol cartridge 800 according to the second embodiment of the present invention comprises a liquid storage element 100 and an independent breath element 600 that communicates the liquid storage element 100 with atmosphere, the independent breath element 600 includes an independent breath element core 640 and at least one independent breath element through-hole 630 axially penetrating through the independent breath element 600.

The aerosol cartridge 800 further comprises an atomizing chamber 934, an atomizing chamber housing 9342, an atomizing chamber through-hole 9341 for communicating the atomizing chamber 934 with the liquid storage element 100, and an atomizer 930. The atomizer 930 blocks the atomizing chamber through-hole 9341, and contacts the liquid in the liquid storage element 100 through the atomizing chamber through-hole 9341. The atomizing chamber through-hole 9341 for communicating the atomizing chamber 934 with the liquid storage element 100 is formed by penetrating through the atomizing chamber housing 9342.

In the present embodiment, the aerosol cartridge 800 comprises an aerosol cartridge housing 810, a housing base 112 provided at the bottom of the aerosol cartridge housing 810, an atomizing chamber housing 9342 provided inside the aerosol cartridge housing 810, anatomizing chamber 934 surrounded by the atomizing chamber housing 9342 and the housing base 112, an aerosol channel 1303 extending from the top of the atomizing chamber housing 9342 to the top of the aerosol cartridge housing 810, a liquid storage element 100 provided among the aerosol cartridge housing 810, the aerosol channel 1303, the atomizing chamber housing 9342 and the housing base 112, and an atomizer 930 provided in the atomizing chamber 934.

The atomizer 930 comprises a heater 931 and an atomizer wicking element 932 heated by the heater 931.

The atomizing chamber housing 9342 is provided with the atomizing chamber through-hole 9341 that communicates the atomizing chamber 934 with the liquid storage element 100 and penetrates through the atomizing chamber housing 9342, and the two ends of the atomizer wicking element 932 pass through the atomizing chamber through-hole 9341 to contact the liquid in the liquid storage element 100. Preferably, the atomizer wicking element 932 is tightly fitted with the atomizing chamber through-hole 9341, the atomizer 930 blocks the atomizing chamber through-hole 9341 and contacts the liquid in the liquid storage element 100 through the atomizing chamber through-hole 9341.

The atomizer 930 is a glass fiber bundle wound with a heating wire, and the glass fiber bundle is the atomizer wicking element 932. The glass fiber bundle passes through a through-hole of the atomizing chamber housing 9342 to contact the liquid in the liquid storage element 100, and the glass fiber bundle is tightly fitted with the through-hole of the atomizing chamber housing 9342.

In the present embodiment, the housing base 112 comprises a first housing base 112*a* provided at the bottommost of the aerosol cartridge housing 810, and a second housing base 112*b* provided inside the aerosol cartridge housing 810 and spaced apart from the first housing base 112*a*, the independent breath element 600 is provided on the second housing base 112*b*.

Specifically, the housing base 112 comprises a first housing base 112*a* and a second housing base 112*b*, the first housing base 112*a* is provided at the bottommost of the aerosol cartridge housing 810, and the second housing base 112*b* is provided above the first housing base 112*a* and spaced apart from each other. The atomizing chamber 934 is surrounded by the atomizing chamber housing 9342 and the second housing base 112*b*. The liquid storage element 100 is provided among the aerosol cartridge housing 810, the aerosol channel 1303, the atomizing chamber housing 9342 and the second housing base 112*b*.

Both the first housing base 112*a* and the second housing base 112*b* are provided with a base through-hole 1122 penetrating through thereof, and one end of the first housing base 112*a* in communication with the outside is served as an air inlet 1121, and the external air enters the space between the first housing base 112*a* and the second housing base 112*b* and the atomizing chamber 934 through the air inlet 1121.

The independent breath element 600 is provided on the second housing base 112*b*, and connects the liquid storage element 100 with the space between the first housing base 112*a* and the second housing base 112*b*. The liquid storage element 100 is connected with the space between the first housing base 112*a* and the second housing base 112*b* through the independent breath element 600, and is connected with the external atmosphere through the base through-hole 1122. The external atmosphere enters the liquid storage element 100 through the air inlet 1121, the base through-hole 1122, the space between the first housing base 112*a* and the second housing base 112*b*, and the independent breath element 600, so that the liquid storage element 100 can communicate with the atmosphere through the independent breath element 600.

As shown in FIG. 2*b*, the independent breath element 600 comprises an independent breath element core 640 and an independent breath element through-hole 630 penetrating through the independent breath element 600, a portion of the second housing base 112*b* constitutes the independent breath element cover 650 of the independent breath element 600. The working principle of the present embodiment is the same as that of the first embodiment.

In the present embodiment, as shown in FIG. 2*c*, an absorbing element 401, such as a sponge or non-woven cloth, can be provided between the first housing base 112*a* and the second housing base 112*b* of the aerosol cartridge 800 to absorb the liquid leaking from the independent breath element 600 under abnormal conditions, thereby further enhancing the leak-proof performance.

Moreover, in the present embodiment, a condensate absorbing element 400 can be provided in the aerosol channel 1303 of the aerosol cartridge 800 to absorb the condensate in the aerosol, thereby further improving user experience.

The Third Embodiment

Figure 3A:
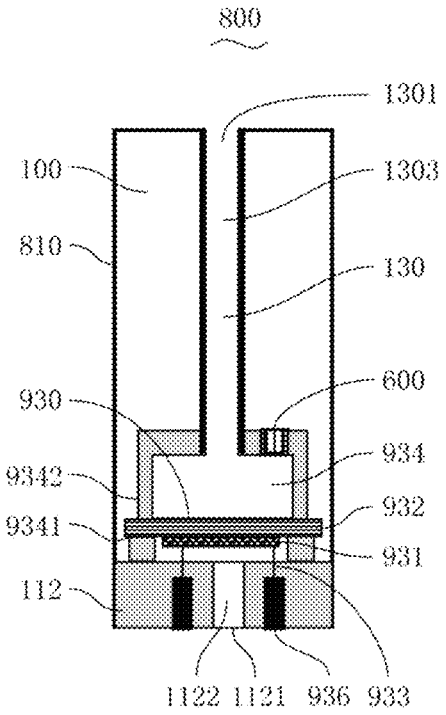
FIG. 3*a* shows a schematic structural view of an aerosol cartridge according to the third embodiment of the present invention.
Figure 3B:
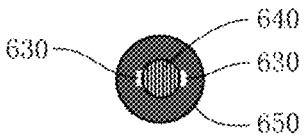
FIG. 3*b* shows a schematic cross-sectional view of an independent breath element in the aerosol cartridge according to the third embodiment.

FIG. 3*a* shows a schematic structural view of an aerosol cartridge according to the third embodiment of the present invention; FIG. 3*b* shows a schematic cross-sectional view of an independent breath element in the aerosol cartridge according to the third embodiment. The structure of the present embodiment is similar to that of the first embodiment, and the same parts as the first embodiment will not be repeated in the description of this embodiment.

As shown in FIG. 3*a*, the aerosol cartridge 800 according to the third embodiment of the present invention comprises a liquid storage element 100 and an independent breath element 600 that communicates the liquid storage element 100 with atmosphere, the independent breath element 600 includes an independent breath element core 640 and at least one independent breath element through-hole 630 axially penetrating through the independent breath element 600.

The aerosol cartridge 800 further comprises an atomizing chamber 934, an atomizing chamber housing 9342, an atomizing chamber through-hole 9341 for communicating the atomizing chamber 934 with the liquid storage element 100, and an atomizer 930. The atomizer 930 blocks the atomizing chamber through-hole 9341, and contacts the liquid in the liquid storage element 100 through the atomizing chamber through-hole 9341. The atomizing chamber through-hole 9341 for communicating the atomizing chamber 934 with the liquid storage element 100 is formed by penetrating through the atomizing chamber housing 9342.

Specifically, in the present embodiment, the aerosol cartridge 800 comprises an aerosol cartridge housing 810, a housing base 112 provided at the bottom of the aerosol cartridge housing 810, an atomizing chamber housing 9342 provided inside the aerosol cartridge housing 810, an atomizing chamber 934 surrounded by the atomizing chamber housing 9342 and the housing base 112, an aerosol channel 1303 extending from the top of the atomizing chamber housing 9342 to the top of the aerosol cartridge housing 810, a liquid storage element 100 provided among the aerosol cartridge housing 810, the aerosol channel 1303, the atomizing chamber housing 9342 and the housing base 112, and an atomizer 930 provided in the atomizing chamber 934.

The atomizer 930 comprises a heater 931 and an atomizer wicking element 932 heated by the heater 931.

The atomizing chamber housing 9342 is provided with the atomizing chamber through-hole 9341 that communicates the atomizing chamber 934 with the liquid storage element 100 and penetrates through the atomizing chamber housing 9342, and the two ends of the atomizer wicking element 932 pass through the atomizing chamber through-hole 9341 to contact the liquid in the liquid storage element 100. Preferably, the atomizer wicking element 932 is tightly fitted with the atomizing chamber through-hole 9341, the atomizer 930 blocks the atomizing chamber through-hole 9341 and contacts the liquid in the liquid storage element 100 through the atomizing chamber through-hole 9341.

As shown in FIG. 3*a*, in the present embodiment, the independent breath element 600 is provided on the top of the atomizing chamber housing 9342, and the atomizer wicking element 932 of the atomizer 930 is a cotton fiber bundle or a glass fiber bundle, the heater 931 of the atomizer 930 is a PCT thermistor, a thick-film resistor printed on porous ceramics, or a thick-film resistor printed on hard ceramics. The working principle of the present embodiment is the same as that of the first embodiment.

As shown in FIG. 3*b*, the independent breath element 600 comprises an independent breath element core 640, an independent breath element cover 650 and an independent breath element through-hole 630 penetrating through the independent breath element 600. A plurality of grooves are formed on the inner peripheral wall of the independent breath element cover 650, so that the grooves located between the independent breath element cover 650 and the independent breath element core 640 form the independent breath element through-hole 630. Preferably, the independent breath element through-hole 630 has two, but may also have one, three, four or more.

The Fourth Embodiment

Figure 4A:
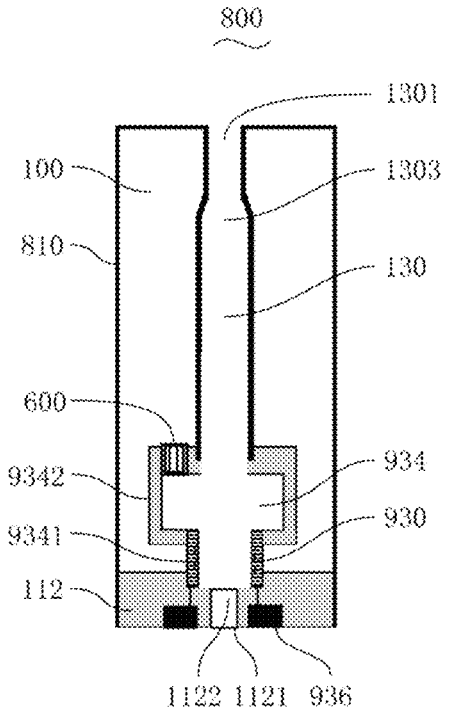
FIG. 4*a* shows a schematic structural view of an aerosol cartridge according to the fourth embodiment of the present invention.
Figure 4B:
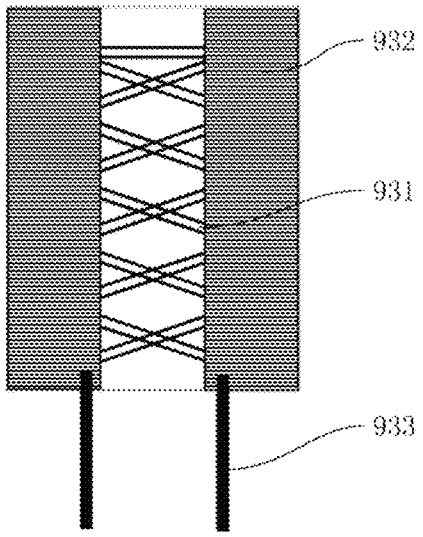
FIG. 4*b* shows a schematic structural view of an atomizer in the aerosol cartridge according to the fourth embodiment.

FIG. 4*a* shows a schematic structural view of an aerosol cartridge according to the fourth embodiment of the present invention; FIG. 4*b* shows a schematic structural view of an atomizer in the aerosol cartridge according to the fourth embodiment. The structure of the present embodiment is similar to that of the first embodiment, and the same parts as the first embodiment will not be repeated in the description of this embodiment.

As shown in FIG. 4*a*, the aerosol cartridge 800 according to the fourth embodiment of the present invention comprises a liquid storage element 100 and an independent breath element 600 that communicates the liquid storage element 100 with atmosphere, the independent breath element 600 includes an independent breath element core 640 and at least one independent breath element through-hole 630 axially penetrating through the independent breath element 600.

The aerosol cartridge 800 further comprises an atomizing chamber 934, an atomizing chamber housing 9342, an atomizing chamber through-hole 9341 for communicating the atomizing chamber 934 with the liquid storage element 100, and an atomizer 930. The atomizer 930 blocks the atomizing chamber through-hole 9341, and contacts the liquid in the liquid storage element 100 through the atomizing chamber through-hole 9341. The atomizing chamber through-hole 9341 for communicating the atomizing chamber 934 with the liquid storage element 100 is formed by penetrating through the atomizing chamber housing 9342.

In the present embodiment, the aerosol cartridge 800 comprises an aerosol cartridge housing 810, a housing base 112 provided at the bottom of the aerosol cartridge housing 810, an atomizing chamber housing 9342 provided inside the aerosol cartridge housing 810, an atomizing chamber 934 surrounded by the atomizing chamber housing 9342 and the housing base 112, an aerosol channel 1303 extending from the top of the atomizing chamber housing 9342 to the top of the aerosol cartridge housing 810, a liquid storage element 100 provided among the aerosol cartridge housing 810, the aerosol channel 1303, the atomizing chamber housing 9342 and the housing base 112, and an atomizer 930 provided in the atomizing chamber 934.

As shown in FIG. 4*b*, in the present embodiment, the atomizer 930 comprises a tubular atomizer wicking element 932 and a heater 931 pre-embedded in the atomizer wicking element 932. The atomizer 930 further comprises a wire 933 connected to a wire pin 936 or a power supply (not shown).

In the present embodiment, the atomizing chamber through-hole 9341 can also be formed by a gap formed between the atomizing chamber housing 9342 and the housing base 112. Specifically, a through-hole is formed on the bottom wall of the atomizing chamber housing 9342 which is penetrating through thereof, and the tubular atomizer 930 extends from the through-hole in the bottom wall to the housing base 112, thereby blocking the atomizing chamber through-hole 9341, that is, the gap between the atomizing chamber housing 9342 and the housing base 112.

Preferably, the bottom of the atomizing chamber housing 9342 is provided with a tubular connection portion (not shown), and the tubular connection portion extends from the through-hole in the bottom wall of the atomizing chamber housing 9342 to the housing base 112 and is connected with the housing base 112, the peripheral wall of the tubular connection portion of the atomizing chamber housing 9342 is provided with an atomizing chamber through-hole (not shown) that penetrates through the atomizing chamber housing 9342 to communicate the atomizing chamber 934 with the liquid storage element 100, the tubular atomizer 930 is tightly fitted with the inner wall of the tubular connection portion and blocks the atomizing chamber through-hole. The tubular connection portion of the atomizing chamber housing 9342 may have a network structure with a plurality of atomizing chamber through-holes, or may have a plurality of strip-shaped atomizing chamber through-holes. The tubular connection portion of the atomizing chamber housing 9342 can also support the installed atomizer 930, further ensuring the stability of installation of the atomizer 930.

Preferably, the atomizer 930 of the present embodiment is a tubular porous ceramic pre-embedded a heating wire or a compressed cotton pre-embedded a heating wire, that is, atomizer wicking element 932 is preferably a porous ceramic or a compressed cotton, the heater 931 is preferably a heating wire. The atomizing chamber housing 9342 is preferably made of silicone rubber, and the atomizer 930 is installed on the atomizing chamber housing 9342 and tightly fitted with the atomizing chamber housing 9342 to prevent liquid leakage. The side of the peripheral wall of the atomizer wicking element 932 is in contact with the liquid of the liquid storage element 100 through the atomizing chamber through-hole.

In the prior art, the porous ceramic pre-embedded a heating wire is a common atomizer 930, the common use method is that the surface of the atomizer 930 is covered with non-woven fabric, and then the atomizer 930 is mounted into the atomizing chamber housing 9342 which is made of the stainless steel. The atomizing chamber housing 9342 is provided with a through-hole in communication with the liquid storage element 100, and the atomizer 930 is mounted at a position where the through-hole is located and is in contact with the liquid in the liquid storage element 100 through the through-hole. In the prior art, it is necessary to properly cooperate the atomizing chamber housing 9342, the covered non-woven fabric and the atomizer 930, so that the liquid can be conducted to the atomizer 930 while the external air can enter the liquid storage element 100 from the non-woven fabric or the gap around the non-woven fabric. Due to the fact that the covered non-woven fabric lacks a fixed shape and is prone to wrinkling, this air breath method is difficult to precisely control. Too much air breath will cause too much liquid on the atomizer 930, which will cause the oil to be exploded during atomization, and will occur liquid leakage when serious; too little air breath will cause the atomizer 930 to be burned due to lack of the liquid. In addition, the work of covering non-woven fabrics is difficult to automate, resulting in low efficiency and height cost.

In the present invention, an independent breath element 600 is provided, which can stably control the negative pressure in the liquid storage element 100, stabilizing the atomization and realizing good leak-proof performance. The independent breath element 600 is provided that the atomizer 930 can tightly fit with the atomizing chamber housing 9342 directly without considering the breath problem. Silicone rubber is resistant to high-temperature and has excellent elasticity, so it is served as the atomizing chamber housing 9342 to be tightly fitted with the atomizer 930, eliminating the risk of liquid leakage, and is suitable for automatic assembly, improving efficiency and reducing costs. The atomizing chamber housing 9342 can also be made of a high-temperature resistant plastic.

The working principle of the present embodiment is the same as that of the first embodiment.

The Fifth Embodiment

Figure 5A:
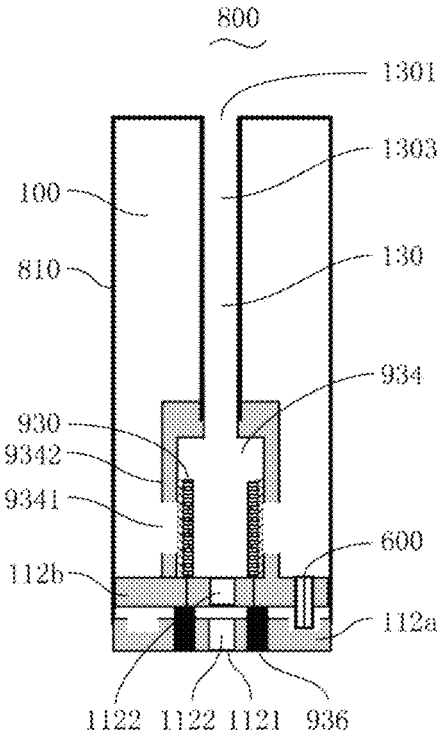
FIG. 5*a* shows a schematic structural view of an aerosol cartridge according to the fifth embodiment of the present invention.
Figure 5B:
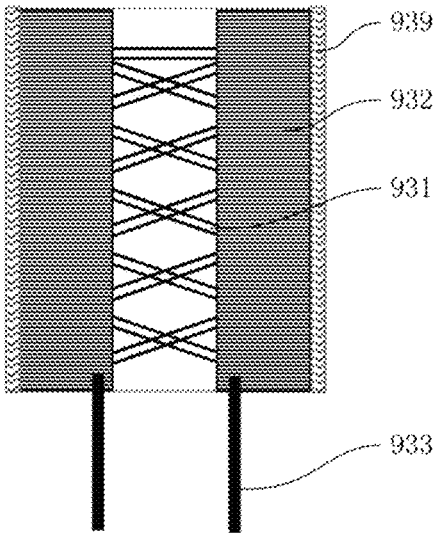
FIG. 5*b* shows a schematic structural view of an atomizer in the aerosol cartridge according to the fifth embodiment.
Figure 5C:
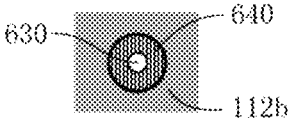
FIG. 5*c* shows a schematic cross-sectional view of an independent breath element in the aerosol cartridge according to the fifth embodiment.

FIG. 5*a* shows a schematic structural view of an aerosol cartridge according to the fifth embodiment of the present invention; FIG. 5*b* shows a schematic structural view of an atomizer in the aerosol cartridge according to the fifth embodiment; FIG. 5*c* shows a schematic cross-sectional view of an independent breath element in the aerosol cartridge according to the fifth embodiment. The structure of the present embodiment is similar to that of the first embodiment, and the same parts as the first embodiment will not be repeated in the description of this embodiment.

As shown in FIG. 5*a*, the aerosol cartridge 800 according to the fifth embodiment of the present invention comprises a liquid storage element 100 and an independent breath element 600 that communicates the liquid storage element 100 with atmosphere, the independent breath element 600 includes an independent breath element core 640 and at least one independent breath element through-hole 630 axially penetrating through the independent breath element 600.

The aerosol cartridge 800 further comprises an atomizing chamber 934, an atomizing chamber housing 9342, an atomizing chamber through-hole 9341 for communicating the atomizing chamber 934 with the liquid storage element 100, and an atomizer 930. The aerosol cartridge 800 further comprises a relay wicking element 939, the atomizer relay wicking element 939 blocks the atomizing chamber through-hole 9341, and contacts the liquid in the liquid storage element 100 through the atomizing chamber through-hole

9341. The atomizing chamber through-hole 9341 for communicating the atomizing chamber 934 with the liquid storage element 100 is formed by penetrating through the atomizing chamber housing 9342.

In the present embodiment, the aerosol cartridge 800 comprises an aerosol cartridge housing 810, a housing base 112 provided at the bottom of the aerosol cartridge housing 810, an atomizing chamber housing 9342 provided inside the aerosol cartridge housing 810, an atomizing chamber 934 surrounded by the atomizing chamber housing 9342 and the housing base 112, an aerosol channel 1303 extending from the top of the atomizing chamber housing 9342 to the top of the aerosol cartridge housing 810, a liquid storage element 100 provided among the aerosol cartridge housing 810, the aerosol channel 1303, the atomizing chamber housing 9342 and the housing base 112, and an atomizer 930 provided in the atomizing chamber 934.

As shown in FIG. 5*b*, in the present embodiment, the atomizer 930 comprises a tubular atomizer wicking element 932 and a heater 931 pre-embedded in the atomizer wicking element 932. The atomizer 930 further comprises a wire 933 connected to a wire pin 936 or a power supply (not shown).

In the present embodiment, the peripheral wall of the atomizer wicking element 932 is covered with a relay wicking element 939. for the relay wicking element 939 is used to communicate the liquid storage element 100 with the atomizer wicking element 932 to conduct the liquid in the liquid storage element 100 to the atomizer wicking element 932.

In the present embodiment, the atomizer wicking element 932 is a porous ceramic or a compressed cotton, and the relay wicking element 939 is a non-woven fabric or a tubular integrated porous body made by thermally bonding of bicomponent fibers. The heater 931 is a heating wire pre-embedded in the atomizer wicking element 932.

The atomizing chamber housing 9342 is provided with an atomizing chamber through-hole 9341 that communicates the atomizing chamber 934 with the liquid storage element 100 and penetrates through the atomizing chamber housing 9342, and the relay wicking element 939 of the atomizer 930 blocks the atomizing chamber through-hole 9341 and is in communication with the liquid in the liquid storage element 100 through the atomizing chamber through-hole 9341. Preferably, the relay wicking element 939 is tightly fitted with the atomizing chamber through-hole 9341 and blocks it, and contacts the liquid in the liquid storage element 100 through the atomizing chamber through-hole 9341.

As shown in FIG. 5*a*, the atomizer 930 is a glass fiber bundle wound with a heating wire, and the glass fiber bundle is the atomizer wicking element 932. The glass fiber bundle passes through a through-hole of the atomizing chamber housing 9342 to contact the liquid in the liquid storage element 100, and the glass fiber bundle is tightly fitted with the through-hole of the atomizing chamber housing 9342.

In the present embodiment, the housing base 112 comprises a first housing base 112*a* provided at the bottommost of the aerosol cartridge housing 810, and a second housing base 112*b* provided inside the aerosol cartridge housing 810 and spaced apart from the first housing base 112*a*, the independent breath element 600 is provided on the second housing base 112*b*.

Specifically, the housing base 112 comprises a first housing base 112*a* and a second housing base 112*b*, the first housing base 112*a* is provided at the bottommost of the aerosol cartridge housing 810, and the second housing base 112*b* is provided above the first housing base 112*a* and spaced apart from each other. The atomizing chamber 934 is surrounded by the atomizing chamber housing 9342 and the second housing base 112*b*. The liquid storage element 100 is provided among the aerosol cartridge housing 810, the aerosol channel 1303, the atomizing chamber housing 9342 and the second housing base 112*b*.

Both the first housing base 112*a* and the second housing base 112*b* are provided with a base through-hole 1122 penetrating through thereof, and one end of the first housing base 112*a* in communication with the outside is served as an air inlet 1121, and the external air enters the space between the first housing base 112*a* and the second housing base 112*b* and the atomizing chamber 934 through the air inlet 1121.

The independent breath element 600 is provided on the second housing base 112*b*, and connects the liquid storage element 100 with the space between the first housing base 112*a* and the second housing base 112*b*. The liquid storage element 100 is connected with the space between the first housing base 112*a* and the second housing base 112*b* through the independent breath element 600, and is connected with the external atmosphere through the base through-hole 1122. The external atmosphere enters the liquid storage element 100 through the air inlet 1121, the base through-hole 1122, the space between the first housing base 112*a* and the second housing base 112*b*, and the independent breath element 600, so that the liquid storage element 100 can communicate with the atmosphere through the independent breath element 600.

As shown in FIG. 5*c*, the independent breath element 600 comprises an independent breath element core 640 and an independent breath element through-hole 630 penetrating through the independent breath element 600, a portion of the second housing base 112*b* constitutes the independent breath element cover 650 of the independent breath element 600. The working principle of the present embodiment is the same as that of the first embodiment.

In the present embodiment, a groove can be provided on the surface of the first housing base 112*a* of the aerosol cartridge 800 which is close to the liquid storage element 100, in order to accommodate the liquid leaked from the independent breath element 600 under abnormal conditions, thereby further enhancing the leak-proof performance.

In the present embodiment, the end of the independent breath element 600 that is close to the second housing base 112*b* extends to near the bottom of the groove, when the pressure in the liquid storage element 100 is lower than the external atmospheric pressure, the liquid leaking into the groove can be sucked back into the liquid storage element 100 through the independent breath element 600, thereby further enhancing the leak-proof performance and improving the utilization rate of the liquid in the liquid storage element 100.

In the present embodiment, an absorbing element (not shown), such as a sponge or non-woven cloth, can be provided between the first housing base 112*a* and the second housing base 112*b* of the aerosol cartridge 800 to absorb the liquid leaking from the independent breath element 600 under abnormal conditions, thereby further enhancing the leak-proof performance.

Moreover, in the present embodiment, a condensate absorbing element (not shown) can be provided in the aerosol channel 1303 of the aerosol cartridge 800 to absorb the condensate in the aerosol, thereby further improving user experience.

In the present embodiment, the atomizing chamber housing 9342 is made of silicone rubber, high-temperature resistant plastic or stainless steel. In the present invention, high-temperature resistant plastic refers to a plastic that can work continuously at at least 150 degrees. The relay wicking element 939 made of fibers can quickly conduct liquid, so it can better support continuous or rapid atomization process. Since the independent breath element 600 is provided, the independent breath element 600 can stably control the negative pressure in the liquid storage element 100. The atomizer 930 is tightly fitted with the atomizing chamber housing 9342 during assembly, which can reduce the risk of liquid leakage. The working principle of the present embodiment is the same as that of the first embodiment.

The Sixth Embodiment

Figure 6A:
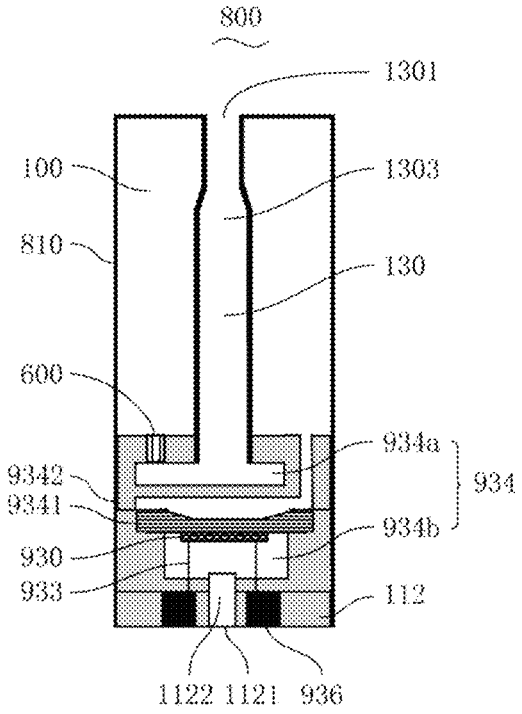
FIG. 6*a* shows a schematic structural view of an aerosol cartridge according to the sixth embodiment of the present invention.
Figure 6B:
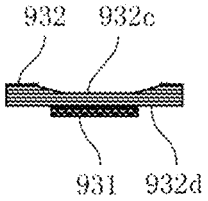
FIG. 6*b* shows a schematic structural view of an atomizer in the aerosol cartridge according to the sixth embodiment.
Figure 6C:
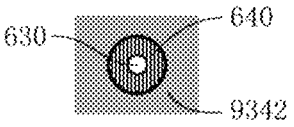
FIG. 6*c* shows a schematic cross-sectional view of an independent breath element in the aerosol cartridge according to the sixth embodiment.

FIG. 6*a* shows a schematic structural view of an aerosol cartridge according to the sixth embodiment of the present invention; FIG. 6*b* shows a schematic structural view of an atomizer in the aerosol cartridge according to the sixth embodiment; FIG. 6*c* shows a schematic cross-sectional view of an independent breath element in the aerosol cartridge according to the sixth embodiment. The structure of the present embodiment is similar to that of the first embodiment, and the same parts as the first embodiment will not be repeated in the description of this embodiment.

As shown in FIG. 6*a*, the aerosol cartridge 800 according to the sixth embodiment of the present invention comprises a liquid storage element 100 and an independent breath element 600 that communicates the liquid storage element 100 with atmosphere, the independent breath element 600 includes an independent breath element core 640 and at least one independent breath element through-hole 630 axially penetrating through the independent breath element 600.

The aerosol cartridge 800 further comprises an atomizing chamber 934, an atomizing chamber housing 9342, an atomizing chamber through-hole 9341 for communicating the atomizing chamber 934 with the liquid storage element 100 and penetrating through the atomizing chamber housing 9342, and an atomizer 930.

The atomizing chamber housing 9342 has an upper atomizing chamber 934*a* and a lower atomizing chamber 934*b*. The lower atomizing chamber 934*b* is provided with an atomizing chamber through-hole 9341 for communicating the lower atomizing chamber 934*b* with the liquid storage element 100. The upper atomizing chamber 934*a* is in communication with the aerosol channel 1303. The atomizer 930 blocks the atomizing chamber through-hole 9341, and contacts the liquid in the liquid storage element 100 through the atomizing chamber through-hole 9341. In the present embodiment, the atomizing chamber through-hole 9341 is a through-hole where the atomizer 930 is installed, thus, the lower atomizing chamber 934*b* is formed by a space surrounded by the atomizing chamber housing 9342 and the bottom surface 932*d* of the atomizer wicking element, and the space surrounded by the atomizing chamber housing 9342 and the upper surface 932*c* of the atomizer wicking element is an extension of the liquid storage element 100. The atomizing chamber through-hole 9341 is blocked by the atomizer 930, so that the upper surface 932*c* of the atomizer wicking element can directly contact the liquid in the liquid storage element 100, and at the same time, it can prevent the liquid in the liquid storage element 100 from penetrating to the bottom surface 932*d* of the atomizer wicking element only through the atomizer wicking element 932, rather than directly leaking into the lower atomizing chamber 934*b*.

The atomizing chamber housing 9342 is made of silicone rubber, the atomizer 930 is installed in the lower atomizing chamber 934*b*, and is tightly fitted with the inner wall of the atomizing chamber housing 9342 of the lower atomizing chamber 934*b* to prevent liquid from leaking to the bottom of the atomizing chamber 934 from the assembled junction.

As shown in FIG. 6*b*, in the present embodiment, the atomizer 930 comprises an atomizer wicking element 932 and a heater 931 provided at the bottom of the atomizer wicking element 932. The atomizer 930 further comprises a wire 933 connected to a wire pin 936 or a power supply (not shown). In the present embodiment, the atomizer 930 is a porous ceramic printed with a thick-film resistor, the heater 931 is the thick-film resistor, and the atomizer wicking element 932 is the porous ceramic. The atomizer wicking element 932 includes an upper surface 932*c* of the atomizer wicking element and a bottom surface 932*d* of the atomizer wicking element. The upper surface 932*c* of the atomizer wicking element preferably has a groove for accommodating liquid. In the present embodiment, the space between the atomizer wicking element 932 and the atomizing chamber housing 9342 constituting the upper atomizing chamber 934*a* is a portion of the liquid storage element 100, the liquid contacts the upper surface 932*c* of the atomizer wicking element and then permeates to the bottom surface 932*d* of the atomizer wicking element, the heater 931 provided on the bottom surface 932*d* of the atomizer wicking element heats and atomizes the liquid that permeates to the bottom surface 932*d* of the atomizer wicking element.

In the present embodiment, the upper atomizing chamber 934*a* and the lower atomizing chamber 934*b* are provided with a channel (not shown) for communicating therebetween. An aerosol is first generated in the lower atomizing chamber 934*b* during atomization, then enters the upper atomizing chamber 934*a* through the channel, finally escapes through the aerosol channel 1303.

In the present embodiment, the independent breath element 600 is independently provided on the top of the atomizing chamber housing 9342. FIG. 6*c* shows a schematic cross-sectional view of the independent breath element, wherein the independent breath element core 640 is made by thermally bonding of bicomponent fibers, an independent breath element through-hole 630 is provided in the independent breath element core 640, and a portion of the atomizing chamber housing 9342 is served as an independent breath element cover 650. Since the liquid can quickly permeate in the independent breath element core 640 made of fibers, the independent breath element 600 can quickly and stably control the negative pressure in the liquid storage element 100, the atomization is stable, and the leak-proof performance is good. Silicone rubber is resistant to high-temperature and has good elasticity, and is served as the atomizing chamber housing 9342 to be tightly fitted and sealed with the atomizer 930, eliminating the risk of liquid leakage. In the present embodiment, the upper half of the atomizing chamber housing 9342 needs to be subjected to low temperature, so that it can be made of plastic; the lower half of the atomizing chamber housing 9342 needs to be subjected to high-temperature and needs to be tightly fitted and sealed with the atomizer 930, so that it is preferably made of silicone rubber.

The working principle of the present embodiment is the same as that of the first embodiment.

The Seventh Embodiment

Figure 7A:
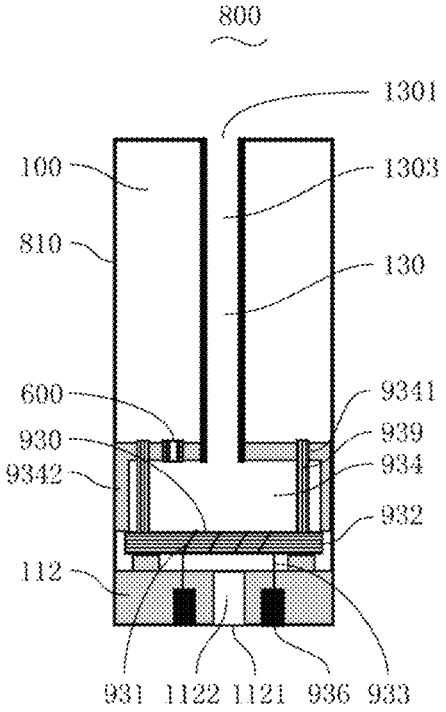
FIG. 7*a* shows a schematic structural view of an aerosol cartridge according to the seventh embodiment of the present invention.
Figure 7B:
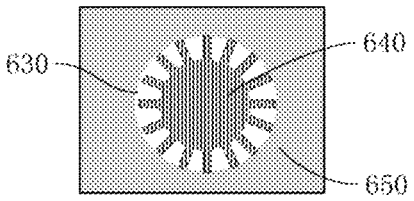
FIG. 7*b* shows a schematic cross-sectional view of an independent breath element in the aerosol cartridge according to the seventh embodiment.

FIG. 7*a* shows a schematic structural view of an aerosol cartridge according to the seventh embodiment of the present invention; FIG. 7*b* shows a schematic cross-sectional view of an independent breath element in the aerosol cartridge according to the seventh embodiment. The structure of the present embodiment is similar to that of the first embodiment, and the same parts as the first embodiment will not be repeated in the description of this embodiment.

As shown in FIG. 7*a*, the aerosol cartridge 800 according to the seventh embodiment of the present invention comprises a liquid storage element 100 and an independent breath element 600 that communicates the liquid storage element 100 with atmosphere, the independent breath element 600 includes an independent breath element core 640 and at least one independent breath element through-hole 630 axially penetrating through the independent breath element 600.

The aerosol cartridge 800 further comprises an atomizing chamber 934, an atomizing chamber housing 9342, an atomizing chamber through-hole 9341 for communicating the atomizing chamber 934 with the liquid storage element 100, and an atomizer 930. The atomizing chamber through-hole 9341 for communicating the atomizing chamber 934 with the liquid storage element 100 is formed by penetrating through the atomizing chamber housing 9342.

In the present embodiment, the aerosol cartridge 800 comprises an aerosol cartridge housing 810, a housing base 112 provided at the bottom of the aerosol cartridge housing 810, an atomizing chamber housing 9342 provided inside the aerosol cartridge housing 810, an atomizing chamber 934 surrounded by the aerosol cartridge housing 810, the atomizing chamber housing 9342 and the housing base 112, an aerosol channel 1303 extending from the top of the atomizing chamber housing 9342 to the top of the aerosol cartridge housing 810, a liquid storage element 100 provided among the aerosol cartridge housing 810, the aerosol channel 1303 and the atomizing chamber housing 9342, and an atomizer 930 provided in the atomizing chamber 934.

As shown in FIG. 7*a*, in the present embodiment, the atomizer 930 comprises a heater 931 and an atomizer wicking element 932 heated by the heater 931. The atomizer 930 further comprises a wire 933 connected to a wire pin 936 or a power supply (not shown). The atomizer 930 is a glass fiber bundle wound with a heating wire, the atomizer wicking element 932 is the glass fiber bundle, and the heater 931 is the heating wire.

The aerosol cartridge 800 further compromises a relay wicking element 939, one end of the relay wicking element 939 blocks the atomizing chamber through-hole 9341 and contacts the liquid in the liquid storage element 100 through the atomizing chamber through-hole 9341, the other end of the relay wicking element 939 abuts against the atomizer wicking element 932. The liquid in the liquid storage element 100 is conducted to the atomizer wicking element 932 through the relay wicking element 939.

In the present embodiment, the atomizing chamber through-hole 9341 is provided at the top of the atomizing chamber housing 9342, and the relay wicking element 939 is perpendicular to the atomizer wicking element 932. Preferably, there are two relay wicking elements 939, which abut against two ends of the atomizer wicking element 932 respectively.

As shown in FIG. 7*b*, in the present embodiment, the independent breath element 600 is provided on the top of the atomizing chamber housing 9342, and is spaced apart from the relay wicking element 939. Multiple fan-shaped cutouts are formed on the peripheral wall of the independent breath element core 640 to form a plurality of the independent breath element through-holes 630, and the fan-shaped independent breath element through-holes 630 are preferably evenly distributed on the outer periphery of the independent breath element core 640, a portion of the atomizing chamber housing 9342 constitutes the independent breath element cover 650. The working principle of the present embodiment is the same as that of the first embodiment.

The Eighth Embodiment

Figure 8A:
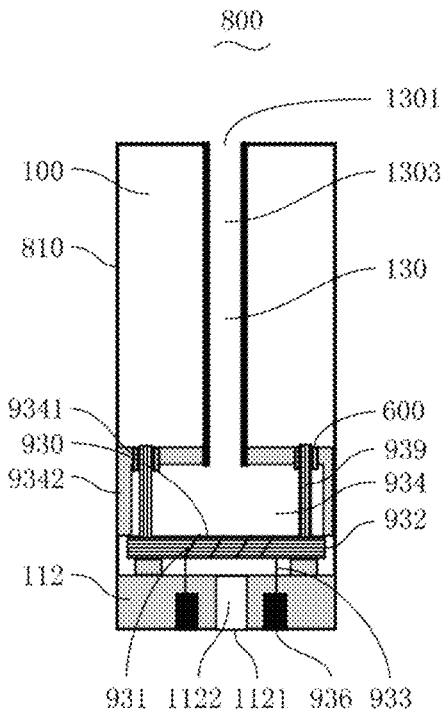
FIG. 8*a* shows a schematic structural view of an aerosol cartridge according to the eighth embodiment of the present invention.
Figure 8B:
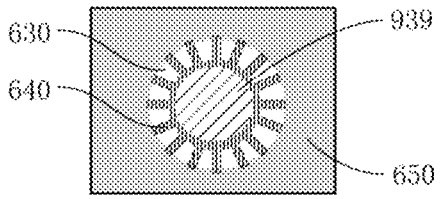
FIG. 8*b* shows a schematic cross-sectional view of an independent breath element in the aerosol cartridge according to the eighth embodiment.

FIG. 8*a* shows a schematic structural view of an aerosol cartridge according to the eighth embodiment of the present invention; FIG. 8*b* shows a schematic cross-sectional view of an independent breath element in the aerosol cartridge according to the eighth embodiment. The structure of the present embodiment is similar to that of the first embodiment, and the same parts as the first embodiment will not be repeated in the description of this embodiment.

As shown in FIG. 8*a*, the aerosol cartridge 800 according to the eighth embodiment of the present invention comprises a liquid storage element 100 and an independent breath element 600 that communicates the liquid storage element 100 with atmosphere, the independent breath element 600 includes an independent breath element core 640 and at least one independent breath element through-hole 630 axially penetrating through the independent breath element 600.

The aerosol cartridge 800 further comprises an atomizing chamber 934, an atomizing chamber housing 9342, an atomizing chamber through-hole 9341 for communicating the atomizing chamber 934 with the liquid storage element 100, and an atomizer 930. The atomizing chamber through-hole 9341 for communicating the atomizing chamber 934 with the liquid storage element 100 is formed by penetrating through the independent breath element 600.

In the present embodiment, the aerosol cartridge 800 comprises an aerosol cartridge housing 810, a housing base 112 provided at the bottom of the aerosol cartridge housing 810, an atomizing chamber housing 9342 provided inside the aerosol cartridge housing 810, an atomizing chamber 934 surrounded by the aerosol cartridge housing 810, the atomizing chamber housing 9342 and the housing base 112, an aerosol channel 1303 extending from the top of the atomizing chamber housing 9342 to the top of the aerosol cartridge housing 810, a liquid storage element 100 provided among the aerosol cartridge housing 810, the aerosol channel 1303 and the atomizing chamber housing 9342, and an atomizer 930 provided in the atomizing chamber 934.

As shown in FIG. 8*a*, in the present embodiment, the atomizer 930 comprises a heater 931 and an atomizer wicking element 932 heated by the heater 931. The atomizer 930 further comprises a wire 933 connected to a wire pin 936 or a power supply (not shown). The atomizer 930 is a glass fiber bundle wound with a heating wire, the atomizer wicking element 932 is the glass fiber bundle, and the heater 931 is the heating wire.

The aerosol cartridge 800 further compromises a relay wicking element 939, one end of the relay wicking element 939 blocks the atomizing chamber through-hole 9341 and contacts the liquid in the liquid storage element 100 through the atomizing chamber through-hole 9341, the other end of the relay wicking element 939 abuts against the atomizer wicking element 932. The liquid in the liquid storage element 100 is conducted to the atomizer wicking element 932 through the relay wicking element 939.

In the present embodiment, the atomizing chamber through-hole 9341 is provided at the top of the atomizing chamber housing 9342, and the relay wicking element 939 is perpendicular to the atomizer wicking element 932. Preferably, there are two relay wicking elements 939, which abut against two ends of the atomizer wicking element 932 respectively.

As shown in FIG. 8*b*, in the present embodiment, the independent breath element 600 is provided on the top of the atomizing chamber housing 9342, and the atomizing chamber through-hole 9341 for communicating the atomizing chamber 934 with the liquid storage element 100 and penetrating through thereof, is provided at the center of the independent breath element 600. Preferably, there are two independent breath elements 600. Multiple fan-shaped cutouts are formed on the peripheral wall of the independent breath element core 640 to form a plurality of the independent breath element through-holes 630, and the fan-shaped independent breath element through-holes 630 are preferably evenly distributed on the outer periphery of the independent breath element core 640, a portion of the atomizing chamber housing 9342 constitutes the independent breath element cover 650. The working principle of the present embodiment is the same as that of the seventh embodiment.

The Ninth Embodiment

Figure 9A:
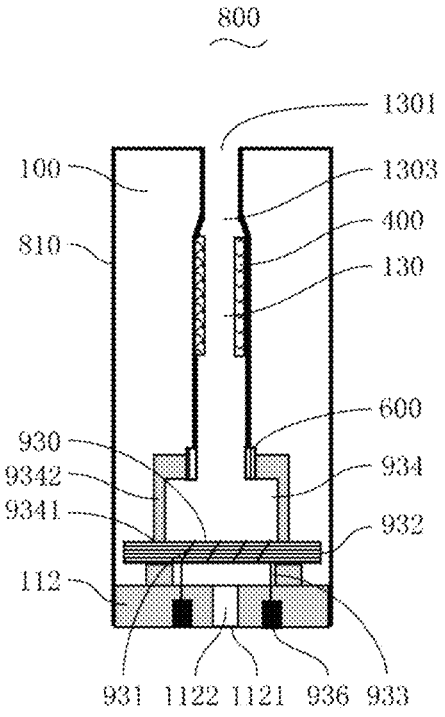
FIG. 9*a* shows a schematic structural view of an aerosol cartridge according to the ninth embodiment of the present invention.
Figure 9B:
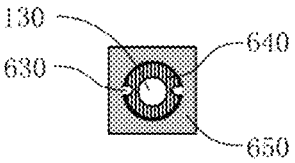
FIG. 9*b* shows a schematic cross-sectional view of an independent breath element in the aerosol cartridge according to the ninth embodiment.

FIG. 9*a* shows a schematic structural view of an aerosol cartridge according to the ninth embodiment of the present invention; FIG. 9*b* shows a schematic cross-sectional view of an independent breath element in the aerosol cartridge according to the ninth embodiment. The structure of the present embodiment is similar to that of the first embodiment, and the same parts as the first embodiment will not be repeated in the description of this embodiment.

As shown in FIG. 9*a*, the aerosol cartridge 800 according to the ninth embodiment of the present invention comprises a liquid storage element 100 and an independent breath element 600 that communicates the liquid storage element 100 with atmosphere, the independent breath element 600 includes an independent breath element core 640 and at least one independent breath element through-hole 630 axially penetrating through the independent breath element 600.

The aerosol cartridge 800 further comprises an atomizing chamber 934, an atomizing chamber housing 9342, an atomizing chamber through-hole 9341 for communicating the atomizing chamber 934 with the liquid storage element 100, and an atomizer 930. The atomizer 930 blocks the atomizing chamber through-hole 9341, and contacts the liquid in the liquid storage element 100 through the atomizing chamber through-hole 9341. The atomizing chamber through-hole 9341 for communicating the atomizing chamber 934 with the liquid storage element 100 is formed by penetrating through the atomizing chamber housing 9342.

In the present embodiment, the aerosol cartridge 800 comprises an aerosol cartridge housing 810, a housing base 112 provided at the bottom of the aerosol cartridge housing 810, an atomizing chamber housing 9342 provided inside the aerosol cartridge housing 810, an atomizing chamber 934 surrounded by the atomizing chamber housing 9342 and the housing base 112, an aerosol channel 1303 extending from the top of the atomizing chamber housing 9342 to the top of the aerosol cartridge housing 810, a liquid storage element 100 provided among the aerosol cartridge housing 810, the aerosol channel 1303, the atomizing chamber housing 9342 and the housing base 112, and an atomizer 930 provided in the atomizing chamber 934.

As shown in FIGS. 9*a* and 9*b*, in the present embodiment, the independent breath element 600 is integrated with the tube wall of the aerosol channel 1303. Specifically, a section of the tube wall of the aerosol channel 1303 that is close to the atomizing chamber housing 9342 is provided to have a larger outer diameter than the rest section, and at least one axial groove is provided on the outer peripheral face of the section of the tube wall with a lager outer diameter, preferably, there are two grooves. When the aerosol channel 1303 is tightly fitted with an opening on the top of the atomizing chamber housing 9342, the grooves are served as the independent breath element through-hole 630, and the portion that the atomizing chamber housing 9342 is equipped with the aerosol channel 1303 is served as the independent breath element cover 650, meanwhile the section of the tube wall of the aerosol channel 1303 with a larger outer diameter is served as the independent breath element core 640. The wall of the aerosol channel 1303 can be made of plastic or metal, that is, the independent breath element 600 is made of plastic or metal.

Similarly, at least one axial groove can also be provided on a section of the wall of the aerosol channel 1303 with the same outer diameter that near the atomizing chamber housing 9342.

As shown in FIG. 9*a*, in the present embodiment, a condensate absorbing element 400 can be installed in the aerosol channel 1303 of the aerosol cartridge 800 to absorb the condensate in the aerosol, thereby further improving the user experience. Preferably, the inner diameter of the middle-upper portion of the aerosol channel 1303 is provided to be smaller than that of the rest portion, so that the condensate absorbing element 400 can be conveniently installed on the inner wall of the aerosol channel 1303 with a larger inner diameter, and the space for absorbing the condensate can also be increased. The working principle of this embodiment is the same as that of the first embodiment.

In conclusion, the aerosol cartridge of the present invention can precisely control the pressure in the liquid storage element, stably conduct the liquid in the liquid storage element, and stabilize the liquid content on the atomizer wicking element, thereby stabilizing the atomization process and reducing the risk of liquid leakage. The independent breath element of the present invention has an ingenious structure, is suitable for use in a small and compact aerosol cartridge, and can flexibly select various types of atomizers according to requirements, and is suitable for various atomizing devices such as electronic cigarettes.

The Tenth Embodiment

Figure 10A:
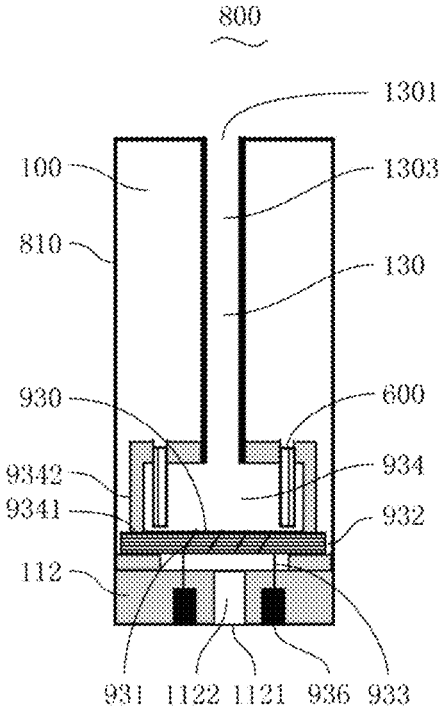
FIG. 10*a* shows a schematic structural view of an aerosol cartridge according to the tenth embodiment of the present invention.
Figure 10B:
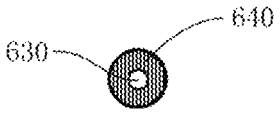
FIG. 10*b* shows a schematic cross-sectional view of an independent breath element in the aerosol cartridge according to the tenth embodiment.

FIG. 10*a* shows a schematic structural view of an aerosol cartridge according to the tenth embodiment of the present invention; FIG. 10*b* shows a schematic cross-sectional view of an independent breath element in the aerosol cartridge according to the tenth embodiment. The structure of the present embodiment is similar to that of the first embodiment, and the same parts as the first embodiment will not be repeated in the description of this embodiment.

As shown in FIG. 10*a*, the aerosol cartridge 800 according to the tenth embodiment of the present invention comprises a liquid storage element 100 and an independent breath element 600 that communicates the liquid storage element 100 with atmosphere, the independent breath element 600 includes an independent breath element core 640 and at least one independent breath element through-hole 630 axially penetrating through the independent breath element 600.

In the present embodiment, the aerosol cartridge 800 comprises an aerosol cartridge housing 810, a housing base 112 provided at the bottom of the aerosol cartridge housing 810, an atomizing chamber housing 9342 provided inside the aerosol cartridge housing 810, an atomizing chamber 934 surrounded by the atomizing chamber housing 9342 and the housing base 112, an aerosol channel 1303 extending from the top of the atomizing chamber housing 9342 to the top of the aerosol cartridge housing 810, a liquid storage element 100 provided among the aerosol cartridge housing 810, the aerosol channel 1303, the atomizing chamber housing 9342 and the housing base 112.

In the present embodiment, the aerosol cartridge 800 further comprises an atomizer 930, the atomizer 930 includes a heater 931 and an atomizer wicking element 932 heated by the heater 931, the lower end surface of the independent breath element 600 extends to near the atomizer wicking element 932.

The atomizing chamber housing 9342 is provided with an atomizing chamber through-hole 9341 that communicates the atomizing chamber 934 with the liquid storage element 100 and penetrates through the atomizing chamber housing 9342, and the two ends of the atomizer wicking element 932 pass through the atomizing chamber through-hole 9341 to contact the liquid in the liquid storage element 100. Preferably, the atomizer wicking element 932 is tightly fitted with the atomizing chamber through-hole 9341, the atomizer 930 blocks the atomizing chamber through-hole 9341 and contacts the liquid in the liquid storage element 100 through the atomizing chamber through-hole 9341.

As shown in FIGS. 10*a* and 10*b*, in the present embodiment, two independent breath elements 600 are provided, wherein the independent breath element core 640 is made by thermally bonding of bicomponent fibers, and the independent breath element through-hole 630 is provided inside the independent breath element core 640. Since the liquid can quickly permeate and form a liquid seal in the independent breath element core 640 made of fibers, the independent breath element 600 can quickly and stably control the negative pressure in the liquid storage element 100, so that the atomization is stable. In the present embodiment, the lower end surface of the independent breath element 600 extends to near the atomizer wicking element 932, so that the liquid leaked from the liquid storage element 100 into the atomizing chamber 934 under abnormal conditions accumulates in the lower end surface of the independent breath element 600 and in the vicinity of the atomizer wicking element 932, which is profit to return the liquid to the liquid storage element 100 from the independent breath element 600 and the atomizer wicking element 932 when the external environment recovers, thereby further enhancing the leakproof performance of the aerosol cartridge 800.

The working principle of the present embodiment is the same as that of the first embodiment.

In addition, the foregoing embodiments of the present disclosure are only intended to illustrate the principle and advantages of the present disclosure rather than limiting the present disclosure. Those skilled in the art can make modifications or changes to the foregoing embodiments without departing from the spirit and scope of the present disclosure. Therefore, all equivalent modifications or changes made by those skilled in the art without departing from the spirit and technical concepts disclosed by the present disclosure shall still be covered by the claims of the present disclosure.

What is claimed is:

1. An aerosol cartridge, wherein the aerosol cartridge comprising a liquid storage element and an independent breath element that communicates the liquid storage element with atmosphere, the independent breath element includes an independent breath element core and at least one independent breath element through-hole axially penetrating through the independent breath element, and the independent breath element core is made by bonding fibers.

2. The aerosol cartridge of claim 1, wherein a maximum inscribed circle diameter of a minimum cross-section of the independent breath element through-hole is 0.05 mm to 1.00 mm.

3. The aerosol cartridge of claim 1, wherein the independent breath element core is made by bonding bicomponent fibers with a sheath-and-core structure.

4. The aerosol cartridge of claim 3, wherein a sheath of the bicomponent fibers is polyethylene, polypropylene, polyethylene terephthalate, a copolyester of polyethylene terephthalate, polytrimethylene terephthalate, polybutylene terephthalate or polyamide 6.

5. The aerosol cartridge of claim 1, wherein the independent breath element core has a density of 0.08-0.50 g/cm$^3$.

6. The aerosol cartridge of claim 1, wherein the aerosol cartridge further comprises an atomizing chamber, an atomizing chamber housing, an atomizing chamber through-hole for communicating the atomizing chamber with the liquid storage element, and an atomizer, wherein the atomizer includes a heater and an atomizer wicking element.

7. The aerosol cartridge of claim 6, wherein the atomizer blocks the atomizing chamber through-hole, and contacts the liquid in the liquid storage element through the atomizing chamber through-hole.

8. The aerosol cartridge of claim 6, wherein the aerosol cartridge further comprises an atomizer relay wicking element made by bonding fibers, the atomizer relay wicking element blocks the atomizing chamber through-hole, and contacts the liquid in the liquid storage element through the atomizing chamber through-hole.

9. The aerosol cartridge of claim 6, wherein the independent breath element communicates the liquid storage element with the atomizing chamber.

10. The aerosol cartridge of claim 1, wherein the aerosol cartridge further comprises an aerosol cartridge housing and a housing base provided at the bottom of the aerosol cartridge housing, and the independent breath element is provided on the housing base.

11. The aerosol cartridge of claim 10, wherein the housing base comprises a first housing base provided at the bottommost of the aerosol cartridge housing, and a second housing base provided inside the aerosol cartridge housing and spaced apart from the first housing base, the independent breath element is provided on the second housing base.

12. The aerosol cartridge of claim 1, wherein the aerosol cartridge further comprises an aerosol channel, and the independent breath element and the aerosol channel are integrally formed.

13. The aerosol cartridge of claim 1, wherein the aerosol cartridge further comprises an atomizer, the atomizer includes a heater and an atomizer wicking element heated by the heater, and the lower end surface of the independent breath element extends to near the atomizer wicking element.

* * * * *